US010400716B2

(12) United States Patent
Yamaguchi

(10) Patent No.: US 10,400,716 B2
(45) Date of Patent: Sep. 3, 2019

(54) INTAKE MANIFOLD

(71) Applicant: TOYOTA BOSHOKU KABUSHIKI KAISHA, Aichi-ken (JP)

(72) Inventor: Takuma Yamaguchi, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/970,175

(22) Filed: May 3, 2018

(65) Prior Publication Data

US 2018/0363600 A1 Dec. 20, 2018

(30) Foreign Application Priority Data

Jun. 14, 2017 (JP) ..... 2017-117265

(51) Int. Cl.
*F02M 35/10* (2006.01)
*F02M 35/116* (2006.01)
*F02M 35/104* (2006.01)

(52) U.S. Cl.
CPC .. *F02M 35/10039* (2013.01); *F02M 35/1036* (2013.01); *F02M 35/1045* (2013.01); *F02M 35/10072* (2013.01); *F02M 35/10144* (2013.01); *F02M 35/10222* (2013.01); *F02M 35/1165* (2013.01)

(58) Field of Classification Search
CPC ..... F02M 35/10039; F02M 35/10072; F02M 35/10144; F02M 35/10222; F02M 35/1165
USPC ..... 123/184.34, 184.47, 568.11, 568.17
See application file for complete search history.

(56) References Cited

U.S. PATENT DOCUMENTS 5,329,912 A * 7/1994 Matsumoto ..... F02B 31/085 123/308
5,957,116 A * 9/1999 Haegele ..... F02M 35/10052 123/568.12
6,167,865 B1 * 1/2001 Ma ..... F02B 17/00 123/184.42
6,553,980 B1 * 4/2003 Nally ..... F02M 35/10039 123/531
6,691,686 B2 * 2/2004 Klas ..... F02B 75/22 123/184.21
8,788,180 B2 * 7/2014 Irisawa ..... F02D 41/0055 123/568.16
2015/0020781 A1 * 1/2015 Keating ..... F02M 35/10222 123/568.11

(Continued)

FOREIGN PATENT DOCUMENTS

JP 2014-118926 6/2014
JP 2016-098745 5/2016

*Primary Examiner* — Erick R Solis
(74) *Attorney, Agent, or Firm* — Greenblum & Bernstein, P.L.C.

(57) ABSTRACT

An intake manifold includes a surge tank and left and right intake pipes containing one end sides each connected to the surge tank, and respectively extending to both side directions of the surge tank. A gas distribution passage portion to distribute exhaust gas to each of the left and right intake pipes is provided along a lower surface side of the surge tank and lower surface sides of the left and right intake pipes. An exhaust gas inlet and a gas distribution passage connected to the exhaust gas inlet are formed on the gas distribution passage portion. A communication hole to communicate an inside of each of the intake pipes and the gas distribution passage is formed on each of the left and right intake pipes.

8 Claims, 4 Drawing Sheets

(56) References Cited

U.S. PATENT DOCUMENTS

| | | | | |
|---|---|---|---|---|
| 2017/0138318 | A1* | 5/2017 | Brygard | F02M 26/17 |
| 2017/0241377 | A1 | 8/2017 | Ito | |
| 2019/0003428 | A1* | 1/2019 | Yamaguchi | F02M 35/10039 |

* cited by examiner

INTAKE MANIFOLD

CROSS-REFERENCE TO RELATED APPLICATION

The present application claims priority under 35 U.S.C. § 119 of Japanese Application No. 2017-117265 filed on Jun. 14, 2017, the disclosure of which is expressly incorporated by reference herein in its entirety.

BACKGROUND

1. Technical Field

The present invention relates to an intake manifold, and more particularly to an intake manifold disposed on an upper portion of a horizontally opposed engine.

2. Related Art

A conventional intake manifold which includes a surge tank containing an air inlet, and a plurality of intake pipes having one end sides each connected to the surge tank and the other end sides respectively connected to intake ports of an engine has been typically known. The intake manifold described above adopts an exhaust gas recirculation (EGR) system which introduces a part of exhaust gas and sends the exhaust gas with intake air to each of combustion chambers of the engine in order to reduce NOx in the exhaust gas and improve fuel efficiency. For example, a technique in which one end side of a conduit through which the exhaust gas flows is connected to a surge tank to introduce the exhaust gas into the surge tank is suggested. According to the intake manifold of the suggested technique, when a large amount of the exhaust gas is introduced, air-fuel ratios (A/F) of cylinders of the engine widely vary each other to deteriorate performance of the engine.

As a solution for the problem described above, another technique in which exhaust gas is directly distributed to each of intake pipes is suggested (refer to, for example, Patent Literature 1; JP 2014-118926 A and Patent Literature 2; JP 2016-098745 A). Patent Literature 1 discloses a technique in which a plate-shaped partition is disposed between an upper member and a lower member both constituting an intake manifold and a gas inlet introducing the exhaust gas to each of intake pipes is formed between the partition and the lower member. Patent Literature 2 discloses a technique in which a gas distribution passage portion is disposed on a surface side opposite to another surface side of each of intake pipes covering an engine to directly distribute the exhaust gas to each of the intake pipes by the distribution passage portion.

According to the technique disclosed in Patent Literature 1, since the gas inlet is formed between two parts, that is, the partition and the lower member, it is difficult to control accuracy of size of the gas inlet due to variation in assembly of two parts. Therefore, variation in air-fuel ratios (A/F) between the cylinders of the engine is increased because of difference in size of the gas inlets of the intake pipes.

Further, according to the technique disclosed in Patent Literature 2, the gas distribution passage portion is disposed on the surface side opposite to another surface side of each of the intake pipes covering the engine. Therefore, the gas distribution passage portion is positioned on upper surface sides of a plurality of the intake pipes when the technique is applied to an intake manifold disposed on an upper portion of a horizontally opposed engine. Because it is difficult to secure a mounting space for parts on the upper surface side of the intake manifold in an engine compartment, the technique disclosed in Patent Literature 2 is not substantially applied to the intake manifold.

SUMMARY

Embodiments of the present invention have been devised in view of the circumstances described above. An object of the present invention is to provide an intake manifold which restrains variation of distribution of exhaust gas to each of intake pipes and which is appropriately disposed in an engine compartment in which a horizontally opposed engine is mounted.

One aspect of the present embodiments provides an intake manifold to be disposed on an upper portion of a horizontally opposed engine, the intake manifold comprising: a surge tank containing an air inlet; and left and right intake pipes containing one end sides each connected to the surge tank, respectively extending to both side directions of the surge tank, and containing the other end sides respectively connected to intake ports of the horizontally opposed engine, wherein a gas distribution passage portion to distribute exhaust gas to each of the left and right intake pipes is provided along a lower surface side of the surge tank and lower surface sides of the left and right intake pipes, an exhaust gas inlet and a gas distribution passage connected to the exhaust gas inlet are formed on the gas distribution passage portion, and a communication hole to communicate an inside of each of the intake pipes and the gas distribution passage is formed on each of the left and right intake pipes.

In a further aspect, the gas distribution passage portion may be provided with a passage body that is integrally formed on a lower surface side of the intake manifold and a cover body that is joined to the passage body to form the gas distribution passage with the passage body.

In a further aspect, the gas distribution passage may be formed into an upwardly inclined shape toward a lower stream side thereof, and the inside of each of the intake pipes and an uppermost portion of the gas distribution passage may be communicated with each other through the communication hole.

In a further aspect, a lowermost portion of the gas distribution passage may be disposed on the lower surface side of the surge tank, and the exhaust gas inlet may be disposed to be connected to the lowermost portion of the gas distribution passage.

In a further aspect, a plurality of the left intake pipes and a plurality of the right intake pipes may be respectively provided in line at both side portions of the surge tank, and the passage body may be integrally formed along the lower surface side of the surge tank, the lower surface sides of the plurality of left intake pipes provided in line, and the lower surface sides of the plurality of right intake pipes provided in line.

In a further aspect, a plurality of the left intake pipes and a plurality of the right intake pipes may be respectively provided in line at both side portions of the surge tank, and the gas distribution passage may branch from the lowermost portion thereof to the left and right, and each of branch end sides of the gas distribution passage may branch to more than one corresponding to the plurality of left intake pipes and the plurality of right intake pipes respectively provided in line.

According to embodiments, an intake manifold includes a surge tank containing an air inlet, and left and right intake pipes containing one end sides each connected to the surge tank, respectively extending to both side directions of the surge tank, and containing the other end sides respectively connected to intake ports of a horizontally opposed engine. A gas distribution passage portion to distribute exhaust gas to each of the left and right intake pipes is provided along a lower surface side of the surge tank and lower surface sides of the left and right intake pipes. An exhaust gas inlet and a gas distribution passage connected to the exhaust gas inlet are formed on the gas distribution passage portion. A communication hole to communicate an inside of each of the intake pipes and the gas distribution passage is formed on each of the left and right intake pipes. According to the structure described above, the exhaust gas introduced into the gas distribution passage from the exhaust gas inlet flows through the gas distribution passage toward a lower stream side, so that the exhaust gas passes through the communication hole and is directly distributed to each of the intake pipes. As described above, since the exhaust gas is distributed from the gas distribution passage to each of the intake pipes through each of the communication holes that is high-precisely formed on each of the intake pipes, variation of distribution of the exhaust gas to each of the intake pipes is restrained. Consequently, variation in air-fuel ratios between the cylinders of the horizontally opposed engine is restrained. Because the gas distribution passage portion is provided on each of the lower surface sides of the surge tank and the left and right intake pipes, the intake manifold is appropriately disposed in the engine compartment in which the horizontally opposed engine is mounted. Further, the gas distribution passage portion functions as a reinforcement rib to improve pressure resistant strength of the surge tank.

In cases where the gas distribution passage portion is provided with a passage body and a cover body, the gas distribution passage is formed between the cover body and the passage body that is integrally formed on a lower surface side of the intake manifold. Hence, the gas distribution passage is formed while the number of parts is reduced, and the passage body further improves a function of the reinforcement rib.

In cases where the gas distribution passage is formed into an upwardly inclined shape toward a lower stream side thereof and the inside of each of the intake pipes and an uppermost portion of the gas distribution passage are communicated with each other through the communication hole, condensed water flows downwardly through the gas distribution passage to be discharged from a lowermost portion of the gas distribution passage even if moisture in the exhaust gas is condensed to generate the condensed water in the gas distribution passage. Therefore, the condensed water is restrained from staying in the gas distribution passage, so that a large amount of the condensed water is restrained from flowing into the intake pipes at once.

In cases where the lowermost portion of the gas distribution passage is disposed on the lower surface side of the surge tank and the exhaust gas inlet is disposed to be connected to the lowermost portion of the gas distribution passage, distances from the exhaust gas inlet to the communication holes are substantially even in the gas distribution passage. Hence, the variation of distribution of the exhaust gas to the intake pipes is further restrained.

In cases where a plurality of the left intake pipes and a plurality of the right intake pipes are respectively provided in line on both side portions of the surge tank and the passage body is integrally formed along the lower surface side of the surge tank and the lower surface sides of the plurality of left intake pipes and the plurality of right intake pipes, the gas distribution passage portion effectively functions as the reinforcement rib to further improve the pressure resistant strength of the surge tank.

In cases where the plurality of left intake pipes and the plurality of right intake pipes are respectively provided in line on both side portions of the surge tank, the gas distribution passage branches to the left and right from the lowermost portion thereof, and each of branch end sides of the gas distribution passage branches to more than one to correspond to the plurality of left intake pipes and the plurality of right intake pipes respectively provided in line, the exhaust gas is more evenly distributed to the left and right intake pipes.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
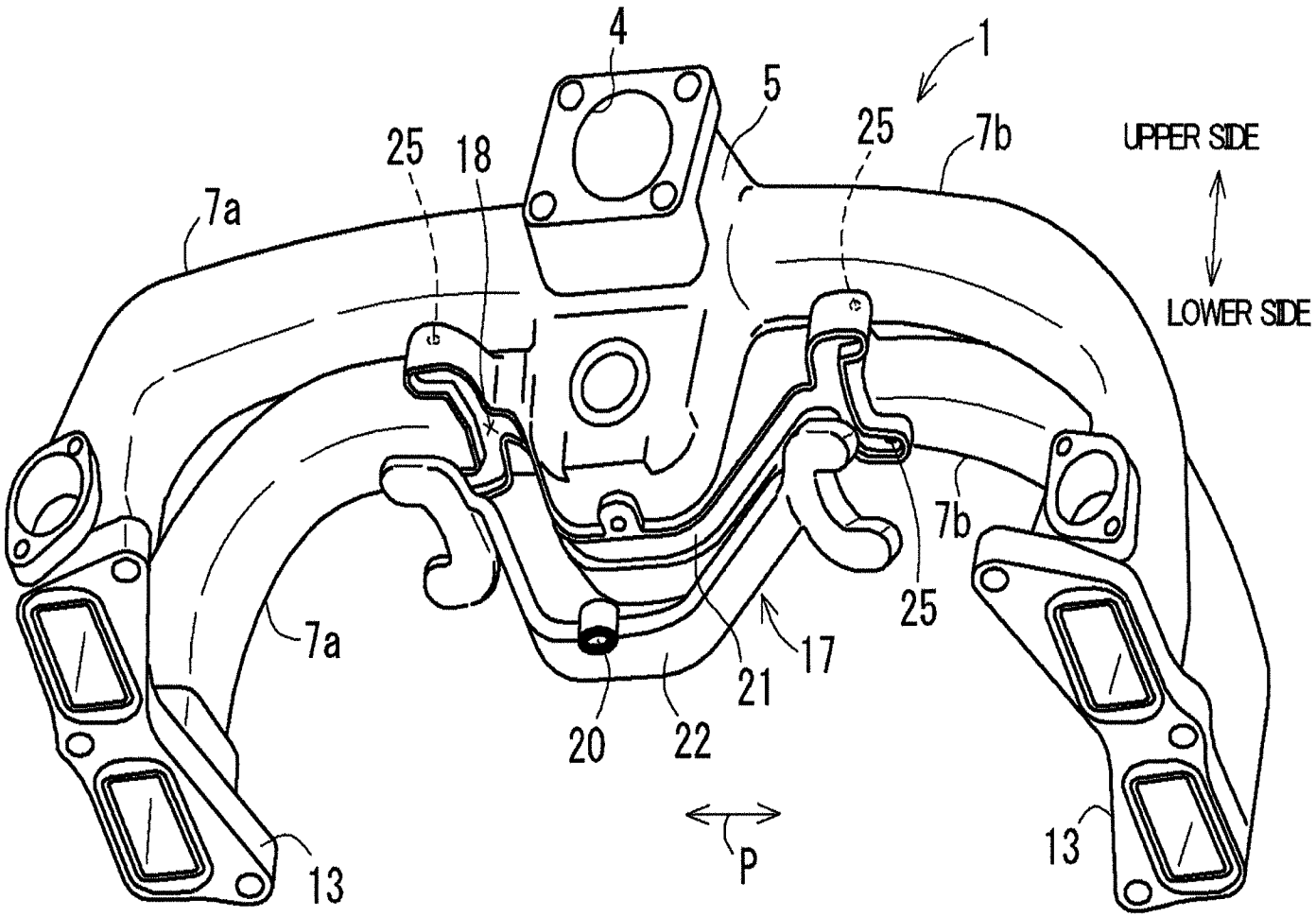
FIG. 1 is a perspective view of an intake manifold (an exploded state of a gas distribution passage portion) in accordance with an example.

According to embodiments, an intake manifold (1) to be disposed on an upper portion of a horizontally opposed engine (2) includes a surge tank (5) containing an air inlet (4) and left and right intake pipes (7*a*, 7*b*) containing one end sides each connected to the surge tank, respectively extending to both side directions of the surge tank, and containing the other end sides respectively connected to intake ports of the horizontally opposed engine (refer to, for example, FIG. 1). A gas distribution passage portion (17) to distribute exhaust gas to each of the left and right intake pipes is provided along a lower surface side of the surge tank (5) and lower surface sides of the left and right intake pipes (7*a*, 7*b*). An exhaust gas inlet (20) and a gas distribution passage (18) connected to the exhaust gas inlet are formed on the gas distribution passage portion. A communication hole (25) to communicate an inside of each of the intake pipes and the gas distribution passage (18) is formed on each of the left and right intake pipes (7*a*, 7*b*) (refer to, for example, FIGS. 2, 3).

Figure 4A:
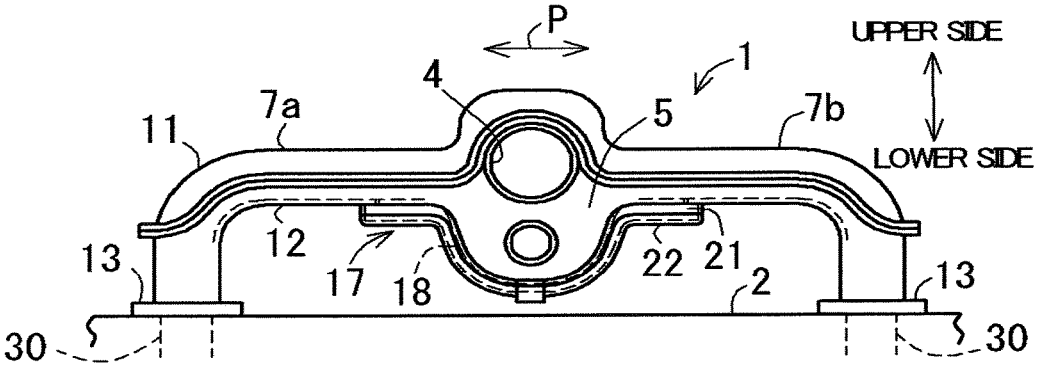
FIG. 4A is a front view of the intake manifold in an assembly state.
Figure 4B:
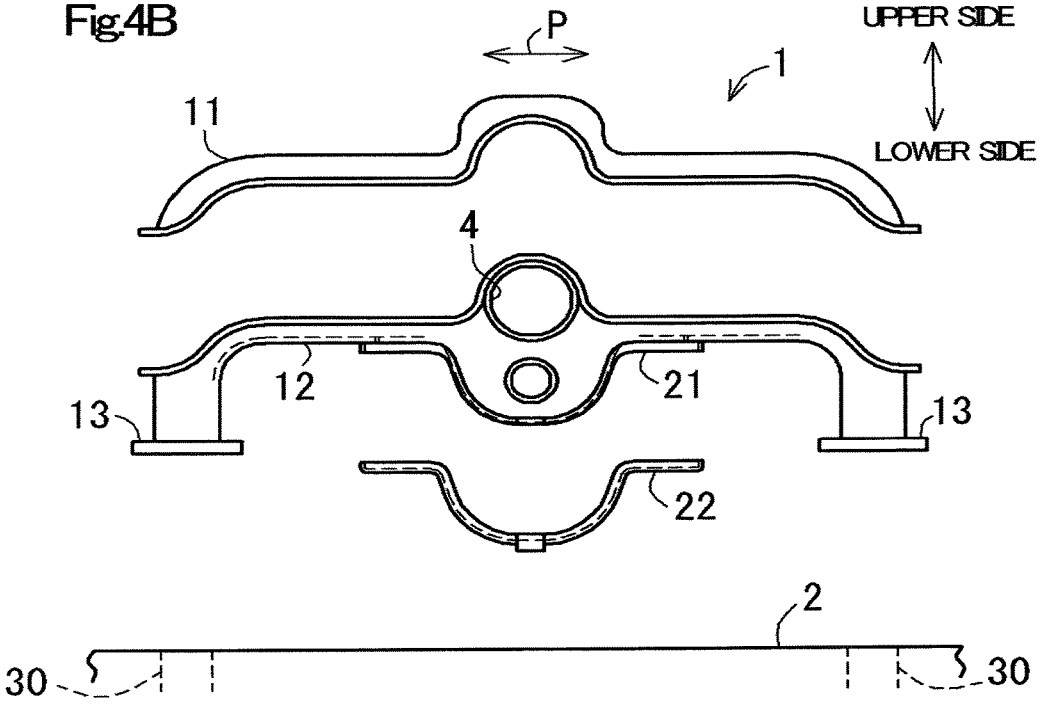
FIG. 4B is a front view of the intake manifold in an exploded state.

As a structure of the intake manifold of this embodiment, for example, it is suggested that the gas distribution passage portion (17) is provided with a passage body (21) integrally formed on a lower surface side of the intake manifold (1) and a cover body (22) joined to the passage body to form the gas distribution passage (18) with the passage body (refer to, for example, FIGS. 4A, 4B). In the structure described above, for example, the passage body (21) may be disposed to cover a gap between the intake pipes (7*a*, 7*b*) which are adjacent to each other (refer to, for example, FIG. 2). Hence, a function of a reinforcement rib is further increased.

Figure 3:
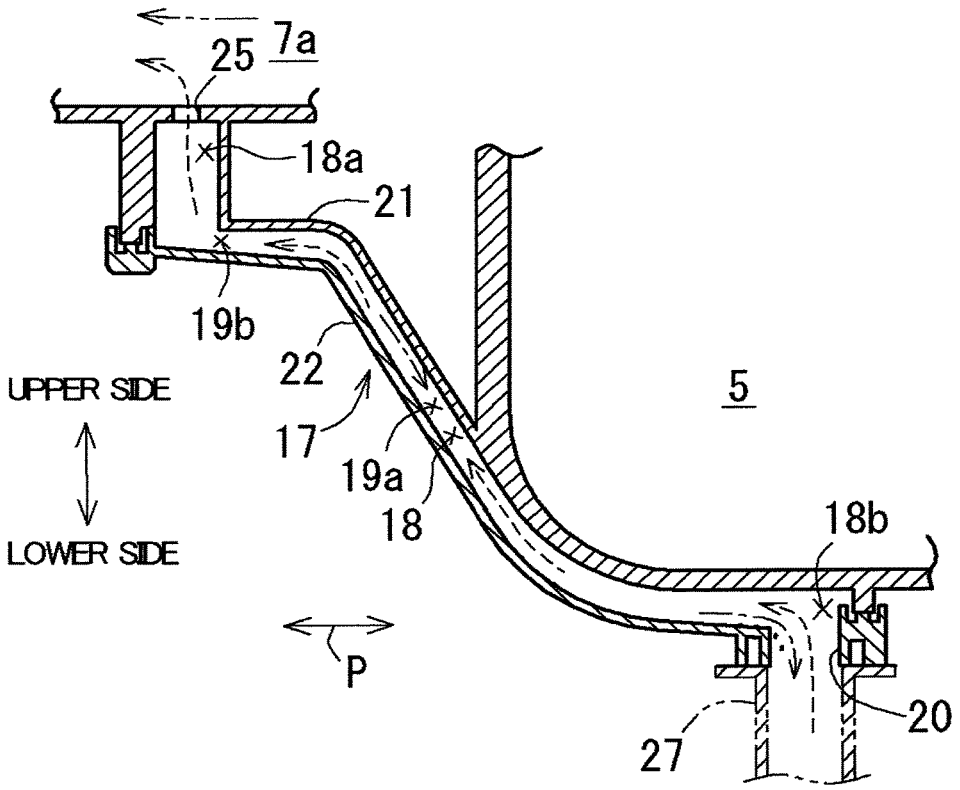
FIG. 3 is an enlarged sectional view taken along line III-III in FIG. 2.

As a structure of the intake manifold of this embodiment, for example, it is suggested that the gas distribution passage (18) is formed into an upwardly inclined shape toward a lower stream side thereof and the inside of each of the intake pipes (7*a*, 7*b*) and an uppermost portion (18*a*) of the gas distribution passage are communicated with each other through the communication hole (25) (refer to, for example, FIG. 3). Incidentally, the term "upwardly inclined shape" described above involves not only a structure only including the upwardly inclined passage portion but also a structure including a substantially horizontal passage portion in addition to the upwardly inclined passage portion as long as the structure does not contain a downwardly inclined passage portion.

As a structure of the intake manifold of this embodiment, for example, it is suggested that a lowermost portion (18*b*) of the gas distribution passage (18) is disposed on the lower surface side of the surge tank (5) and the exhaust gas inlet (20) is disposed to be connected to the lowermost portion (18*b*) of the gas distribution passage (refer to, for example, FIG. 3).

Incidentally, the reference signs in parentheses of the components described in the above embodiment respectively indicate a correspondence with a concrete composition mentioned in examples which will be described later.

EXAMPLES

With reference to the drawings, a concrete description of the present invention will be made hereinafter by way of examples. Incidentally, a width direction "P" of a vehicle, "upper side", and "lower side" in the drawings indicate directions in a state where the intake manifold is disposed in an engine compartment.

(1) Structure of Intake Manifold

Figure 2:
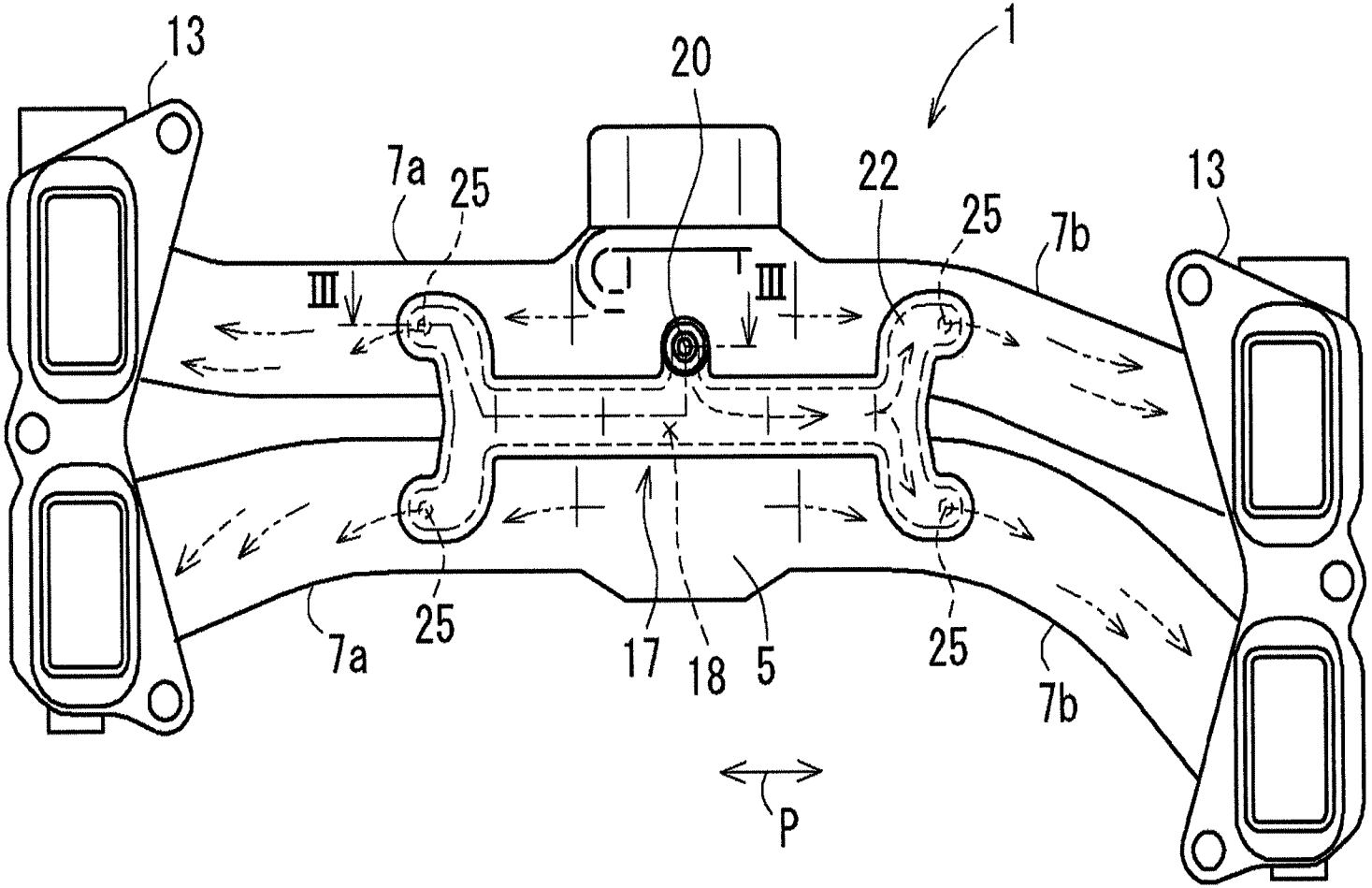
FIG. 2 is a bottom view of the intake manifold.

The intake manifold 1 according to this example is disposed on the upper portion of the horizontally opposed engine 2 (which may be referred to as simply "engine 2" hereinafter) (refer to FIGS. 4A, 4B). As shown in FIGS. 1, 2, the intake manifold 1 includes the surge tank 5 containing the air inlet 4 and the left and right intake pipes 7*a*, 7*b* containing one end sides which are respectively connected to the both side surfaces of the surge tank 5, respectively extending to the both side directions of the surge tank 5 (concretely width directions P of the vehicle), and containing the other end sides which are respectively connected to the intake ports 30 (refer to FIGS. 4A, 4B) of the engine 2. Air (intake air) which passes through an air cleaner (not shown) is introduced into the air inlet 4. A pair of the left intake pipes 7*a*, 7*b* and a pair of the right intake pipes 7*a*, 7*b* are respectively provided on left and right sides so as to correspond to a pair of combustion chambers which are respectively disposed on left and right sides of the engine 2. Tip sides of the intake pipes 7*a*, 7*b* curve downwardly (that is, a side of the engine 2). A flange 13 which is tightened to the side of the engine 2 with bolts or the like is provided on each of the tip sides of the intake pipes 7*a*, 7*b* (refer to FIGS. 4A, 4B).

The intake manifold 1 is formed of synthetic resin of heat resistance, for example, polyamide resin. As shown in FIGS. 4A, 4B, the intake manifold 1 is constructed by joining an upper forming body 11 which forms an upper surface side of the intake manifold 1 and a lower forming body 12 which forms a lower surface side of the intake manifold 1 by, for example, vibration welding. Each of the upper forming body 11 and the lower forming body 12 is formed into a half divided shape obtained by vertically dividing the intake manifold 1 into halves.

As shown in FIGS. 1 to 3, the gas distribution passage portion 17 to distribute the exhaust gas (which is also referred to as "EGR gas") to each of the left and right intake pipes 7*a*, 7*b* is provided along the lower surface side of the surge tank 5 covering the engine 2 and the lower surface sides of the left and right intake pipes 7*a*, 7*b* covering the engine 2. The exhaust gas inlet 20 and the gas distribution passage 18 connected to the exhaust gas inlet 20 are formed on the gas distribution passage portion 17. One end side of a conduit 27 to supply the exhaust gas is connected to the exhaust gas inlet 20 (refer to FIG. 3).

The communication hole 25 to communicate the inside of each of the intake pipes 7*a*, 7*b* and the gas distribution passage 18 is formed on each of the left and right intake pipes 7*a*, 7*b* to penetrate each of the intake pipes 7*a*, 7*b*. Each of the communication holes 25 functions as a gas introducing opening which introduces the exhaust gas flowing through the gas distribution passage 18 into the intake pipes 7*a*, 7*b*. The communication hole 25 is formed on a part of the lower forming body 12 (specifically the passage body 21 described later) which forms the lower surface sides of the intake pipes 7*a*, 7*b*.

The gas distribution passage portion 17 is provided with the passage body 21 which is integrally formed on the lower surface side (specifically, the lower forming body 12) of the intake manifold and the cover body 22 which is joined to the passage body 21 to form the gas distribution passage 18 with the passage body 21. The passage body 21 is formed into a tray shape to be opened on a lower surface side thereof. The passage body 21 is integrally formed along the lower surface side of the surge tank 5 and the lower surface sides of the plurality of left intake pipes and the plurality of right intake pipes 7*a*, 7*b* which are provided in line. The passage body 21 is disposed to cover the gap between the intake pipes 7*a*, (7*b*) which are adjacent to each other. The cover body 22 is formed into a tray shape to be opened on an upper surface side thereof. The cover body 22 is formed of synthetic resin of excellent heat resistance, for example, polyamide resin. The passage body 21 and the cover body 22 are joined to each other by, for example, vibration welding.

As shown in FIG. 3, the gas distribution passage 18 is formed into the upwardly inclined shape toward the lower stream side thereof. The gas distribution passage 18 includes an upwardly inclined passage portion 19*a* (containing a vertical passage portion) and a horizontal passage portion 19*b*. The upwardly inclined passage portion 19*a* extends to be curved. The inside of each of the intake pipes 7*a*, 7*b* and the uppermost portion 18*a* of the gas distribution passage 18 are communicated with each other through the communication hole 25. The lowermost portion 18*b* of the gas distribution passage 18 is disposed on a center portion of the lower surface side of the surge tank 5 in the width direction P of the vehicle (refer to FIG. 2). The exhaust gas inlet 20 is disposed to be connected to the lowermost portion 18*b* of the gas distribution passage 18. The gas distribution passage 18 branches from the exhaust gas inlet 20 to correspond to the communication hole 25 of each of the intake pipes 7*a*, 7*b*. Concretely, the gas distribution passage 18 branches to the left and right from the exhaust gas inlet 20 and each of branch end sides is further divided into two branches.

(2) Operation of Intake Manifold

An operation of the intake manifold 1 having the above structure will be described hereinafter. As shown in FIGS. 2, 3, the exhaust gas (shown by broken arrows) introduced from an exhaust route of the engine 2 into the lowermost portion 18*b* of the gas distribution passage 18 through the exhaust gas inlet 20 flows through the gas distribution passage 18 toward the lower stream side (that is, the uppermost portion 18*a*), so that the exhaust gas passes through each of the communication holes 25 and is distributed to each of the intake pipes 7*a*, 7*b*. The exhaust gas distributed to each of the intake pipes 7*a*, 7*b* is sent to each of the intake ports of the engine 2 with air (shown by two-dot chain line arrows) supplied from the surge tank 5 to each of the intake pipes 7*a*, 7*b*. At this moment, condensed water (shown by chain line arrows in FIG. 3) flows downwardly (that is, toward the lowermost portion 18*b*) through the gas distribution passage 18 to be discharged to a side of the conduit 27 even if moisture in the exhaust gas is condensed to generate the condensed water in the gas distribution passage 18.

(3) Effects in this Example

According to this example, the intake manifold 1 includes the surge tank 5 containing the air inlet 4 and the left and right intake pipes 7*a*, 7*b* containing one end sides each connected to the surge tank 5, respectively extending to both side directions of the surge tank 5, and containing the other end sides respectively connected to the intake ports of the horizontally opposed engine 2. The gas distribution passage portion 17 to distribute the exhaust gas to each of the left and right intake pipes 7*a*, 7*b* is provided along the lower surface side of the surge tank 5 and the lower surface sides of the left and right intake pipes 7*a*, 7*b*. The exhaust gas inlet 20 and the gas distribution passage 18 connected to the exhaust gas inlet 20 are formed on the gas distribution passage portion 17. The communication hole 25 to communicate the inside of each of the intake pipes 7*a*, 7*b* and the gas distribution passage 18 is formed on each of the left and right intake pipes 7*a*, 7*b*. According to the structure described above, the exhaust gas supplied to the gas distribution passage 18 flows through the gas distribution passage 18 toward the lower stream side, so that the exhaust gas passes through the communication hole 25 and is directly distributed to each of the intake pipes 7*a*, 7*b*. As described above, since the exhaust gas is distributed from the gas distribution passage 18 to each of the intake pipes 7*a*, 7*b* through each of the communication holes 25 that is high-precisely formed on each of the intake pipes 7*a*, 7*b*, variation of distribution of the exhaust gas to each of the intake pipes 7*a*, 7*b* is restrained. Consequently, variation in air-fuel ratios between the cylinders of the horizontally opposed engine 2 is restrained. Because the gas distribution passage portion 17 is provided on each of the lower surface sides of the surge tank 5 and the left and right intake pipes 7*a*, 7*b*, the intake manifold 1 is appropriately disposed in the engine compartment in which the horizontally opposed engine 2 is mounted. Further, the gas distribution passage portion 17 functions as the reinforcement rib to improve pressure resistant strength of the surge tank 5. For example, even if a backfire is generated, the surge tank 5 is restrained from being deformed by internal pressure when the backfire occurs.

In this example, the gas distribution passage portion 17 includes the passage body 21 and the cover body 22. According to the structure described above, the gas distribution passage 18 is formed between the passage body 21 that is integrally formed on the lower surface side of the intake manifold 1 and the cover body 22. Hence, the gas distribution passage 18 is formed while the number of parts is reduced, and the passage body 21 further improves a function of the reinforcement rib. Specifically, according to this example, the passage body 21 is disposed to cover the gap between the intake pipes 7*a*, (7*b*) which are adjacent to each other. Hence, the function of the reinforcement rib is further improved.

According to this example, the gas distribution passage 18 is formed into the upwardly inclined shape toward the lower stream side thereof and the inside of each of the intake pipes 7*a*, 7*b* and the uppermost portion 18*a* of the gas distribution passage 18 are communicated with each other through the communication hole 25. According to the structure described above, the condensed water flows downwardly through the gas distribution passage 18 to be discharged from the lowermost portion 18*b* even if the moisture in the exhaust gas is condensed to generate the condensed water in the gas distribution passage 18. Therefore, the condensed water is restrained from staying in the gas distribution passage 18, so that a large amount of the condensed water is restrained from flowing into the intake pipes 7*a*, 7*b* at once.

According to this example, the lowermost portion 18*b* of the gas distribution passage 18 is disposed on the lower surface side of the surge tank 5 and the exhaust gas inlet 20 is disposed to be connected to the lowermost portion 18*b* of the gas distribution passage 18. According to the structure described above, distances from the exhaust gas inlet 20 to the communication holes 25 are substantially even in the gas distribution passage 18. Hence, the variation of distribution of the exhaust gas to each of the intake pipes 7*a*, 7*b* is further restrained.

As many apparently widely different examples of this invention may be made without departing from the spirit and scope thereof, it is to be understood that the invention is not limited to the specific examples thereof except as defined in the appended claims. That is, according to the example described above, the gas distribution passage 18 branches to the left and right from the exhaust gas inlet 20 and each of the branch end sides further branches to extend to each of the intake pipes 7*a*, 7*b*. However, it is to be understood that the present invention is not intended to be limited to this example. For example, the gas distribution passage 18 may radially branch from the exhaust gas inlet 20 to each of the intake pipes 7*a*, 7*b*.

According to the example described above, the gas distribution passage portion 17 is provided with the passage body 21 which is integrally formed on the lower forming body 12 and the cover body 22 which is joined to the passage body 21. However, it is to be understood that the present invention is not intended to be limited to this example. For example, a gas distribution passage portion which is composed of a pair of half divided parts different from the lower forming body 12 may be attached to the lower forming body 12 later. Further, a pipe-shaped gas distribution passage portion which is different from the lower forming body 12 may be attached to the lower forming body 12 later.

According to the example described above, each of the passage body 21 and the cover body 22 is formed into the tray shape. However, it is to be understood that the present invention is not intended to be limited to this example. For example, one of the passage body 21 and the cover body 22 may be formed into the tray shape and the other one may be formed into a plate shape.

According to the example described above, the upper forming body 11, the lower forming body 12, and the cover body 22 are joined to each other by vibration welding. However, it is to be understood that the present invention is not intended to be limited to this example. For example, the upper forming body 11, the lower forming body 12, and the cover body 22 may be joined to each other by, for example, laser welding, ultrasonic welding, thermal welding, induced welding, or adhesion.

According to the example described above, the intake manifold 1 includes the pair of intake pipes 7*a*, (7*b*) which are respectively provided in line on both left and right sides of the surge tank 5. However, it is to be understood that the present invention is not intended to be limited to this example. For example, the intake manifold 1 may include three or more intake pipes which are respectively provided in line on both the left and right sides of the surge tank 5. Incidentally, the shape, the number, and the like of the intake pipes 7*a*, 7*b* are appropriately selected in accordance with the form of the engine 2.

According to the example described above, the intake manifold 1 and the cover body 22 are made of synthetic resin. However, it is to be understood that the present invention is not intended to be limited to this example. For example, the intake manifold 1 and the cover body 22 may be made of metal, for example, aluminum.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

The present invention is widely used as a technology relating to an intake manifold sending air to a horizontally opposed engine which is used in a vehicle such as a passenger car, a bus, or a truck.

What is claimed is:

1. An intake manifold to be disposed on an upper portion of a horizontally opposed engine, the intake manifold comprising:

a surge tank containing an air inlet; and left and right intake pipes containing one end sides each connected to the surge tank, respectively extending to both side directions of the surge tank, and containing the other end sides respectively connected to intake ports of the horizontally opposed engine, wherein a gas distribution passage portion to distribute exhaust gas to each of the left and right intake pipes is provided along a lower surface side of the surge tank and lower surface sides of the left and right intake pipes, an exhaust gas inlet and a gas distribution passage connected to the exhaust gas inlet are formed on the gas distribution passage portion, and a communication hole to communicate an inside of each of the intake pipes and the gas distribution passage is formed on each of the left and right intake pipes.

2. The intake manifold according to claim 1, wherein the gas distribution passage portion is provided with a passage body that is integrally formed on a lower surface side of the intake manifold and a cover body that is joined to the passage body to form the gas distribution passage with the passage body.

3. The intake manifold according to claim 1, wherein the gas distribution passage is formed into an upwardly inclined shape toward a lower stream side thereof, and the inside of each of the intake pipes and an uppermost portion of the gas distribution passage are communicated with each other through the communication hole.

4. The intake manifold according to claim 2, wherein the gas distribution passage is formed into an upwardly inclined shape toward a lower stream side thereof, and the inside of each of the intake pipes and an uppermost portion of the gas distribution passage are communicated with each other through the communication hole.

5. The intake manifold according to claim 3, wherein a lowermost portion of the gas distribution passage is disposed on the lower surface side of the surge tank, and the exhaust gas inlet is disposed to be connected to the lowermost portion of the gas distribution passage.

6. The intake manifold according to claim 4, wherein a lowermost portion of the gas distribution passage is disposed on the lower surface side of the surge tank, and the exhaust gas inlet is disposed to be connected to the lowermost portion of the gas distribution passage.

7. The intake manifold according to claim 2, wherein a plurality of the left intake pipes and a plurality of the right intake pipes are respectively provided in line at both side portions of the surge tank, and the passage body is integrally formed along the lower surface side of the surge tank, the lower surface sides of the plurality of left intake pipes provided in line, and the lower surface sides of the plurality of right intake pipes provided in line.

8. The intake manifold according to claim 5, wherein a plurality of the left intake pipes and a plurality of the right intake pipes are respectively provided in line at both side portions of the surge tank, and the gas distribution passage branches from the lowermost portion thereof to the left and right, and each of branch end sides of the gas distribution passage branches to more than one corresponding to the plurality of left intake pipes and the plurality of right intake pipes respectively provided in line.

* * * * *